US006371825B1

(12) United States Patent
Foreman

(10) Patent No.: US 6,371,825 B1
(45) Date of Patent: Apr. 16, 2002

(54) DOLL HAVING INTERNAL RELIGIOUS IMAGE

(76) Inventor: Elaine Hudson Foreman, 533 Allentown St., Norwood, NC (US) 28128

( * ) Notice: Subject to any disclaimer, the term of this patent is extended or adjusted under 35 U.S.C. 154(b) by 0 days.

(21) Appl. No.: 09/524,874

(22) Filed: Mar. 14, 2000

(51) Int. Cl.[7] ..... A63H 3/00
(52) U.S. Cl. ..... 446/268; 446/219
(58) Field of Search ..... 446/219, 268; 428/3, 29

(56) References Cited

U.S. PATENT DOCUMENTS 1,445,368 A * 2/1923 Street et al.
3,693,281 A 9/1972 Wolf
4,710,145 A * 12/1987 Hall Vandis ..... 446/100
4,878,873 A 11/1989 Yamaguchi et al.
5,094,621 A * 3/1992 Friedel ..... 446/236
5,118,319 A 6/1992 Smith et al.
5,324,201 A 6/1994 Friedel
5,439,407 A 8/1995 Friedel
5,456,625 A 10/1995 Dumond
5,545,072 A 8/1996 Arad et al.
5,636,385 A * 6/1997 Harrison ..... 2/244
5,957,747 A 9/1999 Liggitt

OTHER PUBLICATIONS

Photocopy of religious key chain. (See explanation in IDS for date information).
Photocopy of book mark. (See explanation in IDS for date information).
Photocopy of the packaging accompanying Hercules doll marketed by Walt Disney, Inc. (See explanation in IDS for date information).
Print out of the web site http://members.aol.com/gakall/holopg.html. (See explanation in IDS for date information).

* cited by examiner

*Primary Examiner*—John A. Ricci
(74) *Attorney, Agent, or Firm*—Jenkins & Wilson, P.A.

(57) ABSTRACT

A doll includes an internal religious image such as an image of Jesus Christ to convey to children the idea that God or Jesus Christ exists inside all children. The religious image is preferably a hologram. The image is located in the chest portion of the doll proximally to an aperture. The aperture provides a path for light to enter the doll and illuminate the image.

18 Claims, 3 Drawing Sheets

DOLL HAVING INTERNAL RELIGIOUS IMAGE

TECHNICAL FIELD

The present invention relates to a doll. More particularly, the present invention relates to a doll having an internal religious image.

FIELD OF THE INVENTION

Dolls, such as baby dolls, having internal images are known. For example, U.S. Pat. No. 5,439,407 to Friedel discloses a doll with an imaging heart. The doll includes a translucent heart-shaped area in the chest portion to allow viewing of the interior of the doll. The interior of the doll includes a silhouette portion of an inner child or soul. A lamp inside the doll is located behind the silhouette portion to create a silhouette of a child. The purpose of the doll in Friedel is to encourage a user thereof to get in touch with that which is referred to in psychiatric literature as the "inner child".

Another example of a doll with an internal image is described in U.S. Pat. No. 5,324,201 to Friedel. This patent discloses a doll with an internal cavity for storing icons and includes features for dissuading a person from practicing a vice. The internal cavity is accessible through a front hatch in the doll. Icons that remind the user of a particular vice may be placed in the internal cavity. Example icons that may be placed inside the doll include a plastic liquor bottle, a plastic pill jar, a cardboard box with plastic candies, a paper bank envelope, a teddy bear, a baby doll, a parent doll, a book of instructions or affirmations, and a replica of the doll. Thus, the purpose of the doll described in Friedel is to provide psychotherapy for a person with substance dependency or other psychological/physiological problems.

A variety of other known dolls have either internal or external image projection systems. For example, in U.S. Pat. No. 4,878,873 to Yamaguchi et al. a doll toy in the shape of a man holding a gun is disclosed. The doll toy includes an interior light source that projects a desired pattern onto the trunk and head of the doll. The pattern is overlaid on a frame inside the doll. When the light source is activated, the pattern is projected on the inner surface of the head and trunk. The pattern is also projected outside of the doll. As illustrated in FIG. 2 of Yamaguchi et al., the pattern 19 appears to be an electronic circuit board.

Another doll toy capable of projecting patterns outside of the doll is disclosed in U.S. Pat. No. 5,545,072 to Arad et al. According to Arad et al., a doll toy embodying an action character from the popular "X-Men" comic series is disclosed. The doll includes an internal projection system that projects images stored on a disk inside the toy onto a surface outside the toy. As illustrated in FIG. 6 of Arad et al., example images that are projected include monsters and aliens.

Yet another doll with an internal projection system is disclosed in U.S. Pat. No. 5,118,319 to Smith et al. According to Smith et al., a toy doll includes a self-contained light show. The doll includes a plurality of lights located on the exterior surface of the doll. The lights are activated in a predetermined sequence to give the appearance of a light show.

U.S. Pat. No. 3,693,281 to Wolf discloses a viewing kit for a model such as a model airplane. The viewing kit includes a lens and an aperture that allows the user to view the inside of the model airplane, such as the cockpit.

Various dolls of religious figures are also known. For example, U.S. Pat. No. 5,456,625 to Dumond discloses a doll formed in the likeness of Jesus Christ with movable head and extremities. According to Dumond, the doll of Jesus is provided with electrically conductive nails, which when inserted through the apertures in the hands of the doll mount the doll to a cross and close an electrical circuit, which illuminates a cross.

Another example of a religious doll is disclosed in U.S. Pat. No. 5,957,747 to Liggit. According to the '747 Patent, a doll is formed in the likeness of Jesus Christ. The doll includes a heart-shaped locket attached to the chest of the doll. Liggett states that a photograph of the intended user can be placed inside the locket to indicate to the user that Jesus loves the user.

While the above-mentioned prior art discloses dolls having internal images of therapeutic value, toy dolls having interior or exterior projection systems, and religious dolls, none of these dolls are designed to impart the feeling to a child that Jesus Christ or God is inside of the child. Thus, there exists a need for a doll with an internal image that communicates to the child that God or Jesus Christ is inside of all children. Such a doll is preferably constructed in a manner that reduces the need for complex internal electrical circuitry for viewing the image.

DISCLOSURE OF THE INVENTION

The present invention includes a doll, such as a baby doll, having an internal religious image. In a preferred embodiment, the internal image comprises a hologram. The hologram is positioned inside the chest portion of the doll. An aperture is located in the body of the doll proximally to the internal image to provide illumination and to allow viewing of the image. The image may be an image of Jesus Christ or other religious figure or symbol.

Accordingly, it is an object of the invention of provide a novel doll with an internal religious image.

It is yet another object of the invention to provide a novel doll with an, internal religious hologram.

It is another object of the invention to provide a novel doll with an internal religious image that is easy to manufacture.

It is yet another object of the present invention to provide a method for communicating to children the presence of God or Jesus inside of all children.

Some of the objects of the invention having been stated hereinabove, other objects will be evident as the description proceeds, when taken in connection with the accompanying drawings as best described hereinbelow.

BRIEF DESCRIPTION OF THE DRAWINGS

The present invention will now be explained in detail with reference to the accompanying drawings of which.

DETAILED DESCRIPTION OF THE INVENTION

Figure 1:
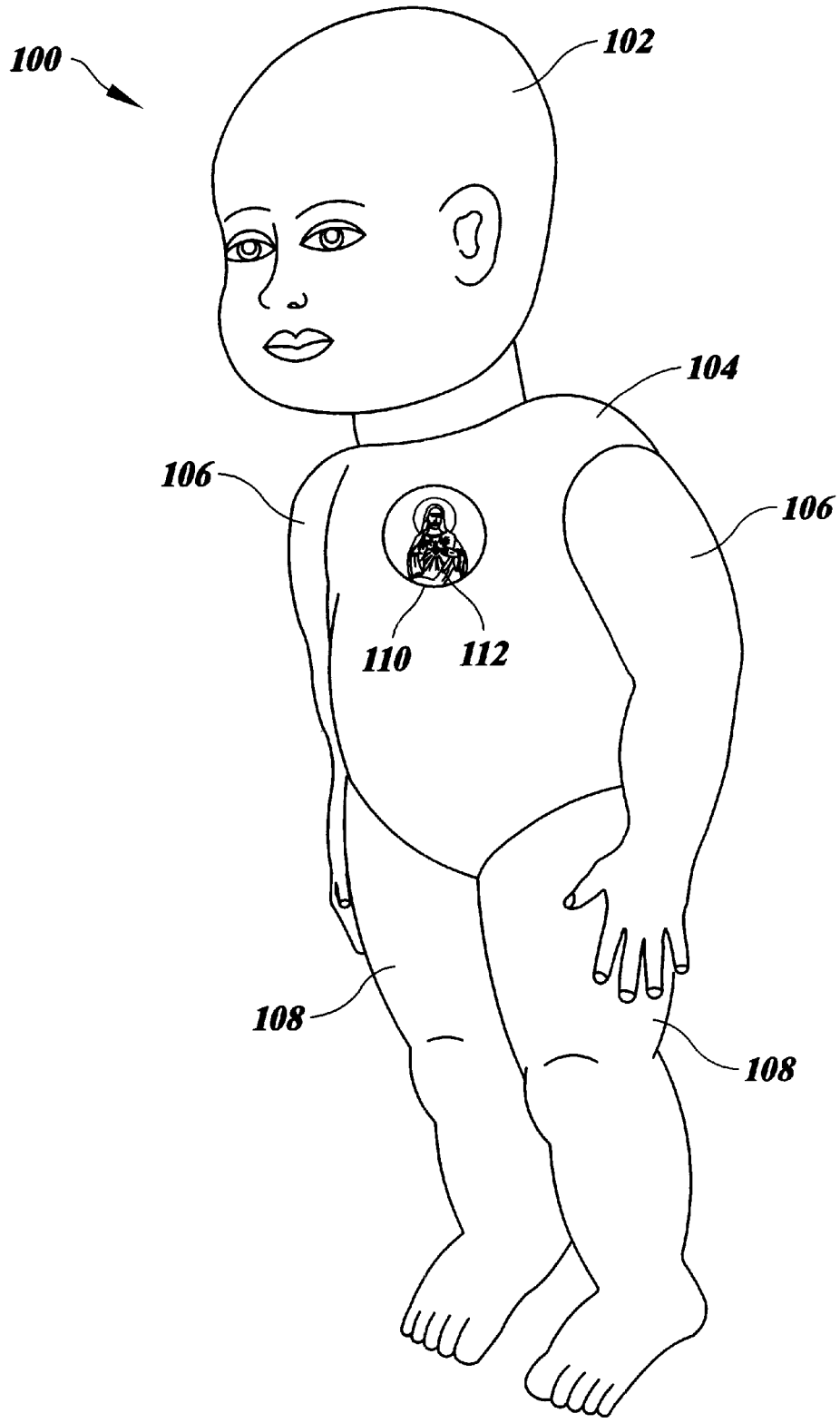
FIG. 1 is a perspective view of a doll having an internal religious image according to an embodiment of the present invention.

FIG. 1 is a perspective view of a doll having an internal religious image according to an embodiment of the present invention. In FIG. 1, doll 100 is a baby doll. As such doll 100 includes a body including a head portion 102, a torso portion 104, arms 106, and legs 108. Torso portion 104 includes aperture 110 to allow illumination and viewing of religious image 112 located in the interior region of doll 100. In a preferred embodiment of the invention, image 112 comprises a hologram. Doll 100 can be constructed of any suitable material, such as rubber, plastic, ceramic, wood, or any combination thereof.

Figure 2:
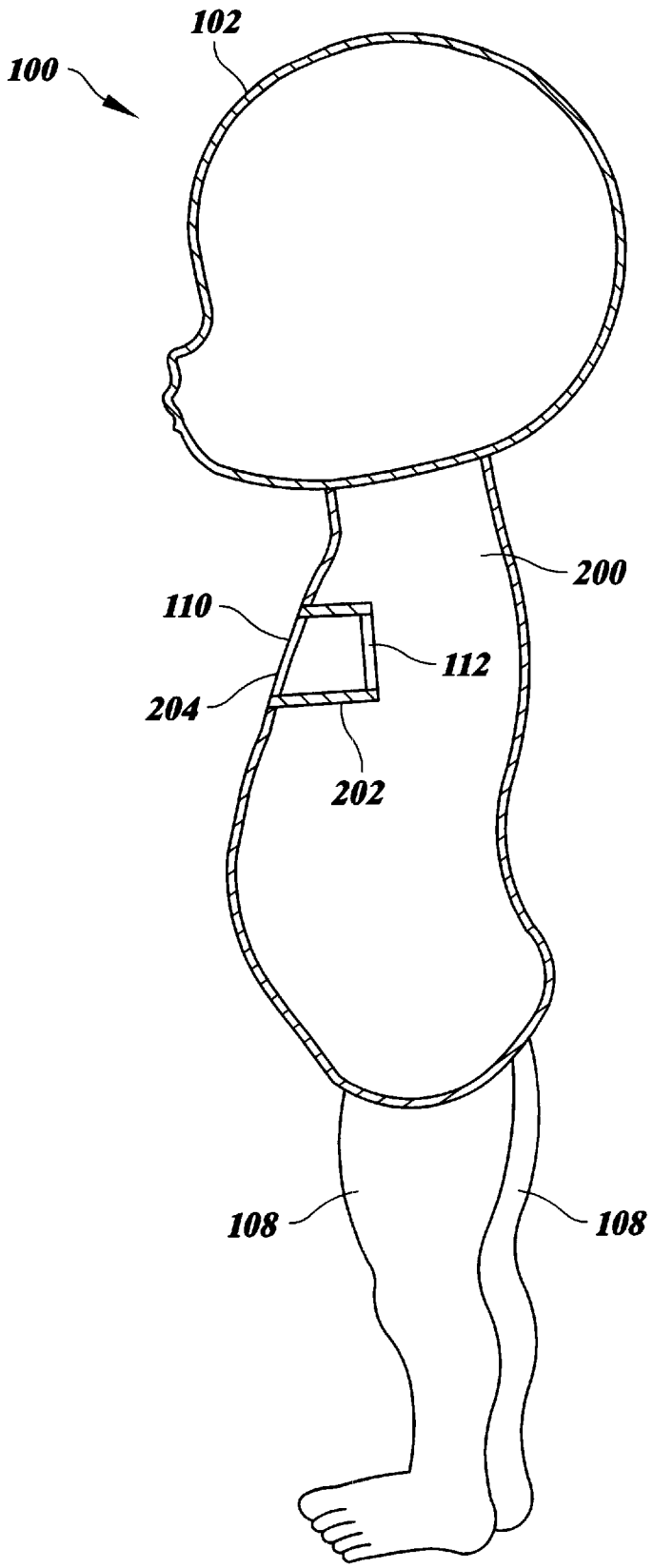
FIG. 2 is a sectional view of a doll having an internal religious image according to an embodiment of the present invention.

FIG. 2 is a sectional view of the head and torso portion of doll 100 illustrated in FIG. 1. In FIG. 2, arms 106 are omitted to facilitate explanation of the interior region of doll 100. In the illustrated embodiment, doll 100 includes interior region 200. Religious image 112 is located in interior region 200. Support structure 202 holds image 112 proximally to aperture 110. Support structure 202 also provides a passageway for light to illuminate image 112 and facilities viewing of image 112 from outside of doll 100. In a Preferred embodiment of the invention, support structure 202 comprises a rigid cylinder. For example, support structure 202 may be made of hard plastic or other rigid material.

Aperture 110 is preferably covered by translucent member 204. Translucent member 204 may be variously configured. For example, translucent member 204 may simply be a sheet of clear plastic that matches the contour of doll 100. In an alternative embodiment, translucent member 204 may comprise a lens, such as a convex lens, to facilitate viewing of image 112. In such an embodiment, image 112 may be located at the focal point of convex lens 204. In yet another alternative embodiment, translucent member 204 may be omitted to allow maximum illumination of image 112.

As stated above, according to a preferred embodiment of the invention, image 112 is preferably a hologram. A hologram is a light wave interference pattern recorded on photographic film or other suitable surface that can produce a three-dimensional image when illuminated properly. The hologram can be created by illuminating a three-dimensional model with a split beam, red krypton laser. One beam from the laser, referred to as the object beam, illuminates the model. The other beam, referred to as the reference beam, illuminates a specially coated glass plate. The laser beams meet to create a microscopic diffraction pattern, which is recorded on the glass plate and used to transfer the image onto a holographic film. The diffraction foil is created by cutting thousands of tiny grooves into an embossing plate. These closely spaced parallel grooves in an embossing plate reflect the light into all colors of the spectrum.

Using a religious hologram inside of the doll provides a number of advantages. First, no light source is required to illuminate the hologram from behind. A hologram can be completely illuminated by light entering from the front side of the image. Accordingly, in the present embodiment, there is no requirement of a light source, such as a battery-powered light source, inside of doll 100. As a result, using a hologram decreases the manufacturing cost of doll 100 and increases child safety. However, the present invention is not limited to a doll without an interior light source. An interior light source, such as a battery-powered incandescent lamp, may be included inside the doll to provide additional illumination of image 112.

Another advantage to using a hologram is that children will desire to hold doll 100 at different angles with respect to a light source to facilitate viewing of image 112. The reflective properties of a hologram make the image maximally viewable when light rays impact the hologram at a predetermined angle. This angle depends on the relative positions of the doll and the light source. For example, when the hologram is viewed from the original direction of the reference beam, a three-dimensional image appears where the object was originally located. Because the user may be required to tilt or move the doll to enhance visibility of the image, a hologram encourages the user to play with the doll.

Yet another advantage of using a hologram for image 112 is that holograms are colorful and pleasing to the eye. For example, when a hologram is turned at an angle to the light source, the hologram appears to be three-dimensional. The combination of color and three-dimensional viewing make a hologram especially well suited for portraying a religious image such as an image of Jesus Christ.

Figure 3:
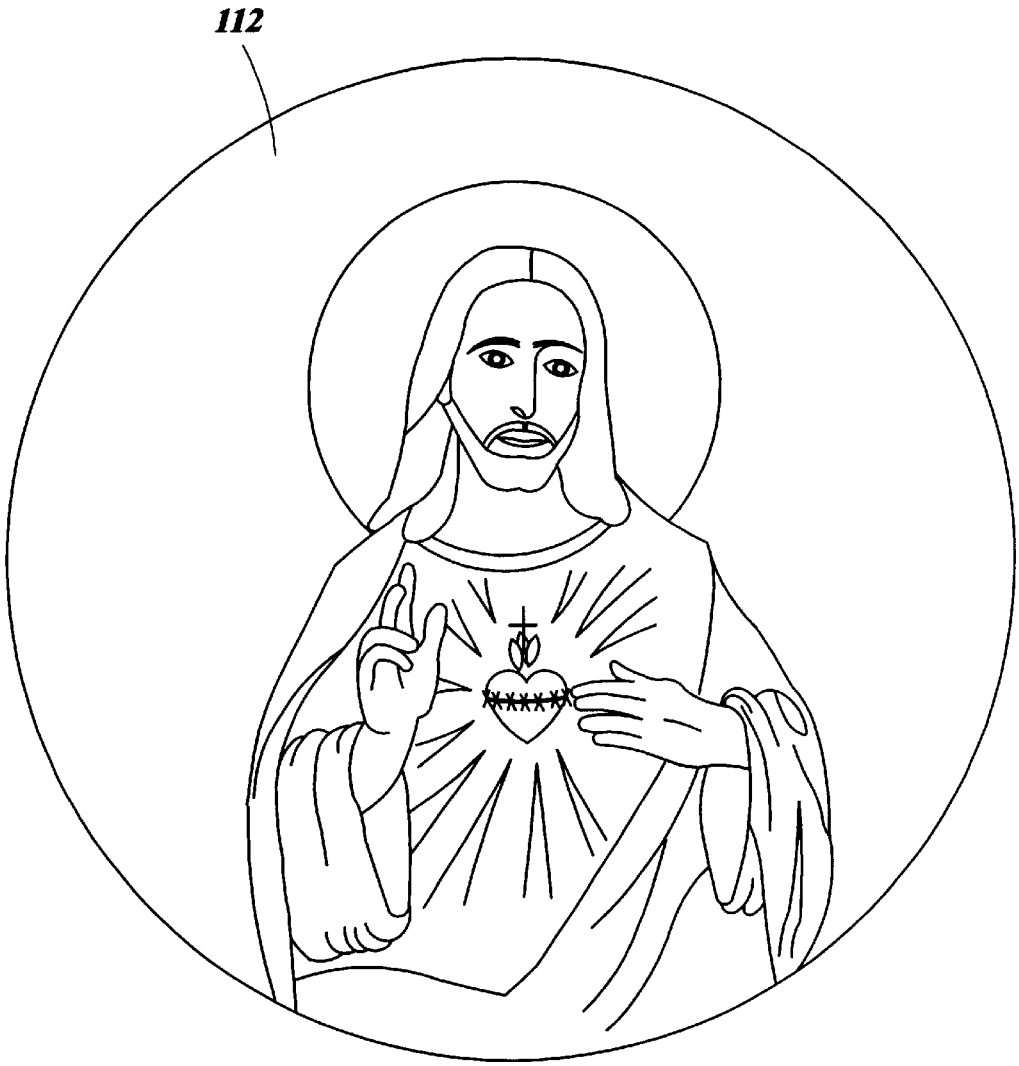
FIG. 3 illustrates an example of a religious image that may be included in a doll according to embodiments of the present invention.

FIG. 3 illustrates an example of a religious image suitable for use as image 112. In the illustrated embodiment, image 112 comprises an image of Jesus Christ. Using an image of Jesus Christ is preferred because such an image is readily associated with a supreme being by Christian children. However, the present invention is not limited to using an image of Jesus Christ. For example, in an alternative embodiment, the image may be another Christian image, such as a cross or a fish. In yet another alternative, the image may be a Jewish image, such as the Star of David or a menorah. In yet another alternative the image may be an Islamic image such as an image of Mohammed or Allah. Any religious image that conveys to the doll user the presence of a supreme being inside of children is within the scope of the invention.

Although a hologram is preferred, the present invention is not limited to a hologram. Any two-dimensional or three-dimensional religious image is within the scope of the invention.

It will be understood that various details of the invention may be changed without departing from the scope of the invention. Furthermore, the foregoing description is for the purpose of illustration only, and not for the purpose of limitation—the invention being defined by the claims.

What is claimed is:

1. A doll having an internal religious image, the doll comprising:

(a) a body having a wall defining an interior region and an exterior region, the wall having at least one aperture for allowing viewing of the interior region from the exterior region;

(b) a religious hologram of Jesus Christ located in the interior region proximally to the aperture to allow viewing and illumination of the hologram through the aperture, wherein the doll does not include a light source inside the body for illuminating the hologram; and (c) a support structure for holding the hologram proximally to the aperture and for providing a path for light to flow between the hologram and the aperture, wherein the support structure comprises a cylinder.

2. The doll of claim 1 wherein the body is shaped substantially like a baby and the aperture is located in a chest portion of the body.

3. The doll of claim 1 comprising a translucent member for covering the aperture.

4. The doll of claim 3 wherein the translucent member comprises a plastic material.

5. The doll of claim 3 wherein the translucent member comprises a lens.

6. The doll of claim 5 wherein the translucent member comprises a convex lens.

7. The doll of claim 1 wherein the body comprises a plastic material.

8. The doll of claim 1 wherein the body comprises a rubber material.

9. The doll of claim 1 wherein the body comprises a ceramic material.

10. The doll of claim 1 wherein the body comprises a wooden material.

11. The doll of claim 1 wherein the religious hologram of Jesus Christ is positioned within the body to allow viewing and illumination of the hologram without using an internal light source.

12. A doll comprising:

(a) a body having a wall defining an interior region and an exterior region, the wall having at least one aperture;

(b) a translucent member for covering the aperture; and (c) a religious hologram of Jesus Christ located in the interior region proximally to the aperture to allow viewing and illumination of the image through the aperture, wherein the doll does not include a light source inside the body for illuminating the hologram.

13. The doll of claim 12 wherein the body is shaped substantially like a baby and the aperture is located in a chest portion of the body.

14. The doll of claim 12 comprising a rigid member for holding the hologram in a fixed position with regard to the aperture and for providing a path for light to flow between the aperture and the hologram.

15. The doll of claim 12 wherein the translucent member comprises a plastic material.

16. The doll of claim 12 wherein the translucent member comprises a lens.

17. The doll of claim 12 wherein the translucent member comprises a convex lens.

18. The doll of claim 12 wherein the religious hologram of Jesus Christ is positioned within the body to allow viewing and illumination of the hologram without using an internal light source.

* * * * *